US006733196B2

(12) United States Patent
Lee et al.

(10) Patent No.: US 6,733,196 B2
(45) Date of Patent: May 11, 2004

(54) STROKE-LIMITED KEY STRUCTURE AND KEYBOARD INCLUDING THE STRUCTURE

(75) Inventors: Tong-Hsueh Lee, Taipei (TW); Chi-Hung Chen, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/306,557

(22) Filed: Nov. 27, 2002

(65) Prior Publication Data

US 2003/0113153 A1 Jun. 19, 2003

(30) Foreign Application Priority Data

Dec. 14, 2001 (TW) ..... 90221942 U

(51) Int. Cl.[7] ..... B41J 5/14

(52) U.S. Cl. ..... 400/480; 400/490; 400/492; 400/495; 200/344

(58) Field of Search ..... 400/472, 480, 400/481, 490, 492, 498; 200/344

(56) References Cited

U.S. PATENT DOCUMENTS 5,772,008 A * 6/1998 Yu et al. ..... 200/344
6,270,268 B1 * 8/2001 Kawabe ..... 400/488
6,328,489 B1 * 12/2001 Chi-Pin ..... 400/496
6,375,372 B1 * 4/2002 Tsau ..... 400/490
6,382,856 B2 * 5/2002 Hu ..... 400/495
6,428,223 B2 * 8/2002 Chen ..... 400/495
6,504,121 B2 * 1/2003 Hasunuma ..... 200/344
6,550,993 B2 * 4/2003 Lu et al. ..... 400/490
6,623,195 B2 * 9/2003 Lin ..... 400/490

* cited by examiner

*Primary Examiner*—Andrew H. Hirshfeld
*Assistant Examiner*—Dave A. Ghatt
(74) *Attorney, Agent, or Firm*—Snell & Wilmer L.L.P.

(57) ABSTRACT

The present invention relates to a stroke-limited key structure and a keyboard including the key. The key structure includes a base, a scissors-shaped member, and a cap. The scissors-shaped frame is disposed on the base, and the cap is disposed on the scissors-shaped member. The scissors-shaped frame includes a first frame and a second frame that is rotatably coupled to the first frame. The first and second frames include a first protrusion and a second protrusion. The stroke of the key is limited by using the engagement between the first and second protrusions.

10 Claims, 12 Drawing Sheets

STROKE-LIMITED KEY STRUCTURE AND KEYBOARD INCLUDING THE STRUCTURE

CROSS REFERENCE TO RELATED APPLICATIONS

This application claims priority of Taiwan Patent Application No. 090221942 filed on Dec. 14, 2001.

FIELD OF INVENTION

The present invention relates to a key structure and a keyboard. More particularly, the present invention relates to a key with a limited stroke and a scissors-shaped member.

BACKGROUND OF THE INVENTION

Keyboards are widely used with various devices, such as computers, to input characters and numerals.

To make a key on the keyboard easy to depress, the key is usually designed to function no matter where a force is exerted on the key cap. In other words, even though the force is exerted on the edge of the cap, it is equally distributed over the entire surface of the cap. Generally, to this purpose, a scissors-shaped frame is used to form the key structure. It is especially true for the keyboard of portable computer device requiring minimum space, such as super-slim portable computer.

Controlling stroke of key is important to a keyboard, especially to a keyboard used with a portable computer device. Conventionally, because the scissors-shaped member described above may not limit the stroke of key, two methods are used to limit the stroke. In the first method, the stroke is limited to the height of elastic component of the key. However, this method may not precisely control the stroke.

In the second method, a groove is arranged on a base of the key, and a latch is connected with an edge of the cap through the groove. When the cap is elevated to a predetermined position, the latch engages with an edge of the groove to stop the cap. This method may precisely control the stroke; however, it increases the time and difficulty of manufacture process.

Accordingly, problem of the stroke limitation still exists.

SUMMARY OF THE INVENTION

The first aspect of the present invention is providing a key with limited stroke and a scissors-shaped member.

Another aspect of the present invention is providing a key with limited stroke by using a relatively simple manufacture process.

Another aspect of the present invention is providing a keyboard including the key described above.

The key structure of the present invention includes a base, a scissors-shaped member, and a cap. The scissors-shaped member is disposed on and coupled to the base. The scissors-shaped member also includes a first frame and a second frame. The first and second frames respectively have a first and a second protrusions. The cap is disposed on and connected with the scissors-shaped member. The cap may vertically move relative to the base due to a relative rotation between the first and second frames.

In a first embodiment, when the cap is elevated to a first position, the fist protrusion engages with the second protrusion to stop the cap. Thus, the upward stroke of the key may be limited.

In a second embodiment, when the cap is depressed and lowered to a second position, the first protrusion engages with the second protrusion to stop the cap. Thus, the downward stroke of the key may be limited.

In a third embodiment, the second protrusion further includes a first end and a second end. The first protrusion engages with the first end to stop the cap while the cap is elevated to the first position. The first protrusion engages with the second end to stop the cap while the cap is depressed to the second position. Thus, both the upward and downward strokes of the key may be limited.

These and other aspects of the present invention will become clear to those of ordinary skill in the art after having read the following detailed description of the preferred embodiment which is illustrated in the various figures and drawings.

BRIEF DESCRIPTION OF THE DRAWINGS

The various features and advantages are hereinafter described in the following detailed description of illustrative embodiments to be read in conjunction with the accompanying drawing figures, wherein like reference numerals are used to identify the same or similar parts in the similar views, and.

DETAILED DESCRIPTION

The present invention provides a keyboard and a key structure with a scissors-shaped member for limiting a stroke of the key. The present invention is disclosed in detail using the following illustrative embodiments.

First Embodiment

Figure 1A:
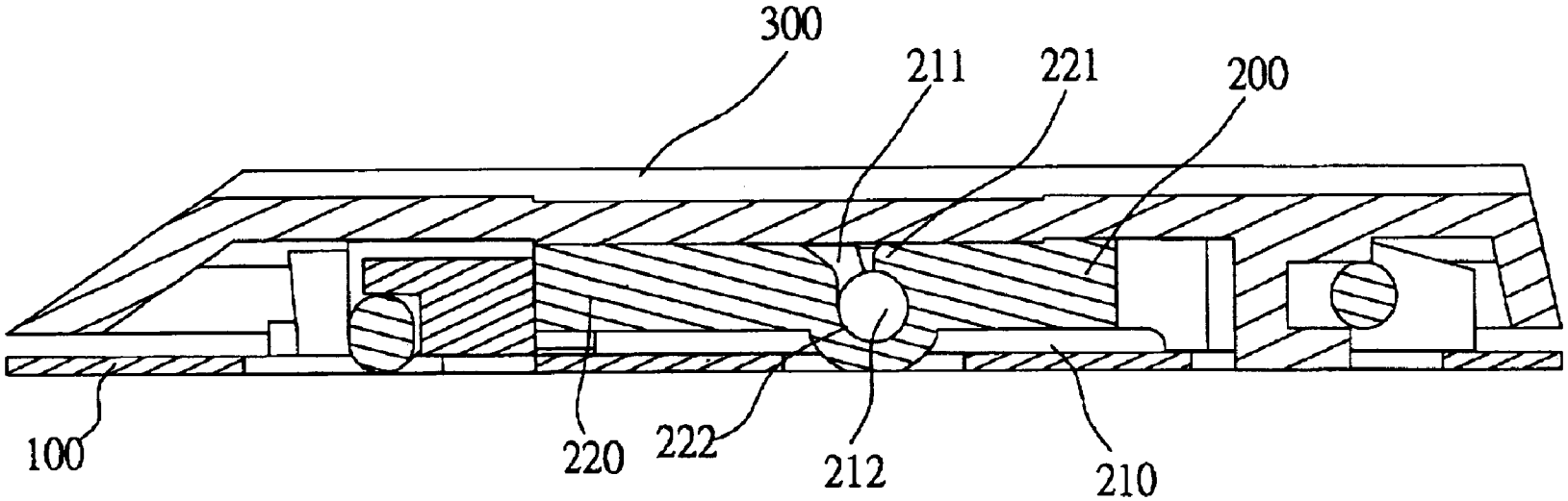
FIG. 1*a* depicts a first embodiment of the present invention with the cap lowered to the second position.
Figure 1B:
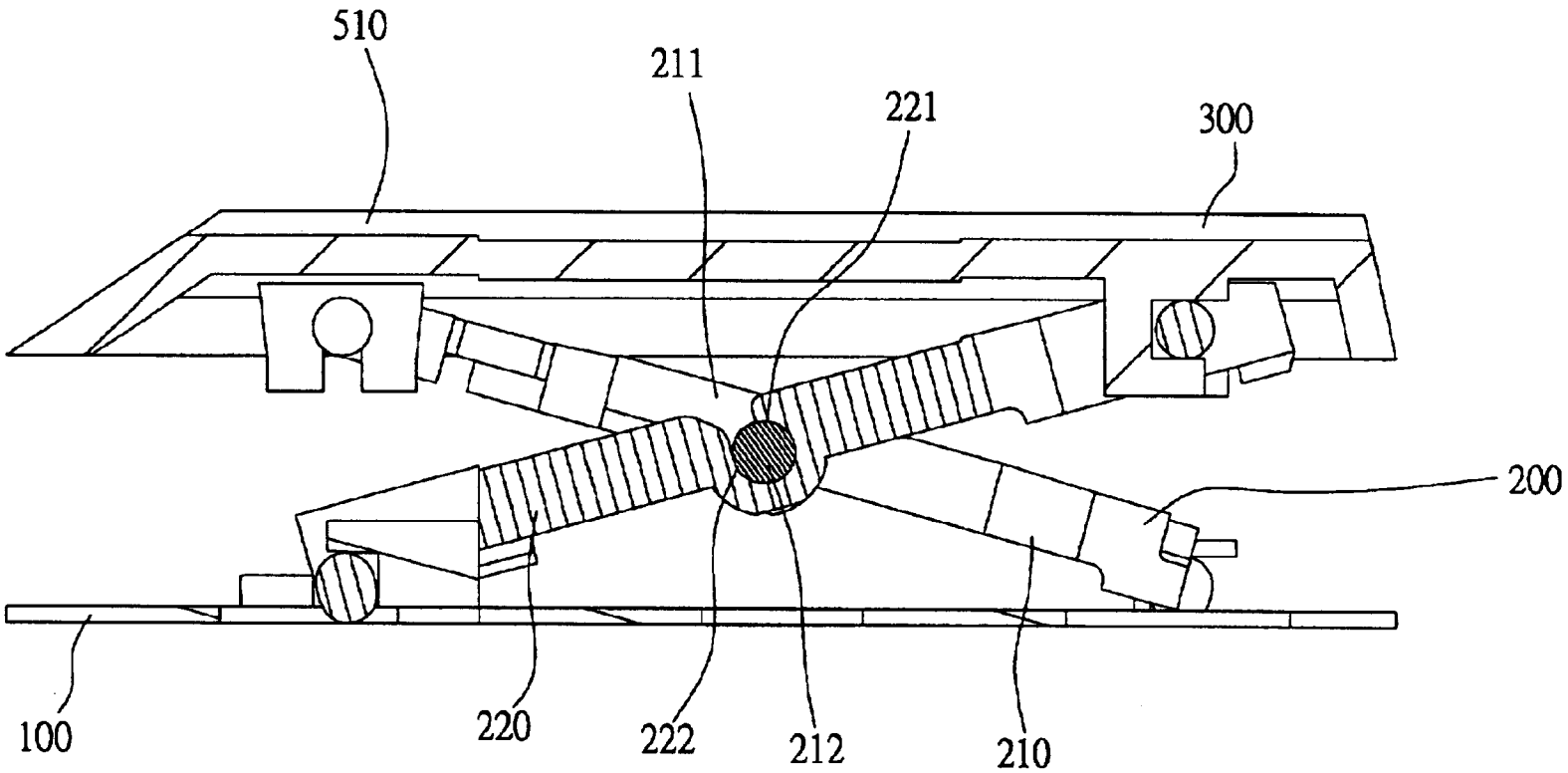
FIG. 1*b* depicts another view of the embodiment shown in FIG. 1*a* with the cap elevated to the first position.

FIG. 1*a* and FIG. 1*b* illustrate a key structure in accordance with one embodiment of the invention. FIG. 1*a* illustrates a first embodiment of the present invention with the cap depressed, and FIG. 1*b* illustrates another view of the embodiment with the cap elevated. The key structure of the present invention includes a base 100, a scissors-shaped member 200, and a cap 300. The scissors-shaped member 200 is disposed on and coupled to the base 100. The scissors-shaped member 200 also includes a first frame 210 and a second frame 220. The first and second frames 210 and 220 respectively have a first and a second protrusions 211 and 221. The cap 300 is disposed on and connected with the scissors-shaped member 200.

The cap 300 may vertically move relative to the base 100 due to a relative rotation between the first and second frames 210 and 220, as FIG. 1*a* shows. When the cap 300 is elevated to a first position 510, as FIG. 1*b* shows, the fist protrusion 211 engages with the second protrusion 221 to stop the cap 300. Thus, the upward stroke of the key may be limited.

The connections between the scissors-shaped member 200 and the base 100 and between the scissors-shaped member 200 and cap 300 may be implemented by various methods. In an embodiment of the present invention, the first frame 210 is rotatably connected with the base 100 and is rotatably and movably connected with the cap 300. The second frame 220 is rotatably connected with the cap 300 and is rotatably and movably connected with the base 100. In another embodiment, however, the first and second frames may be rotatably and movably connected with both the base 100 and the cap 300.

Figure 2A:
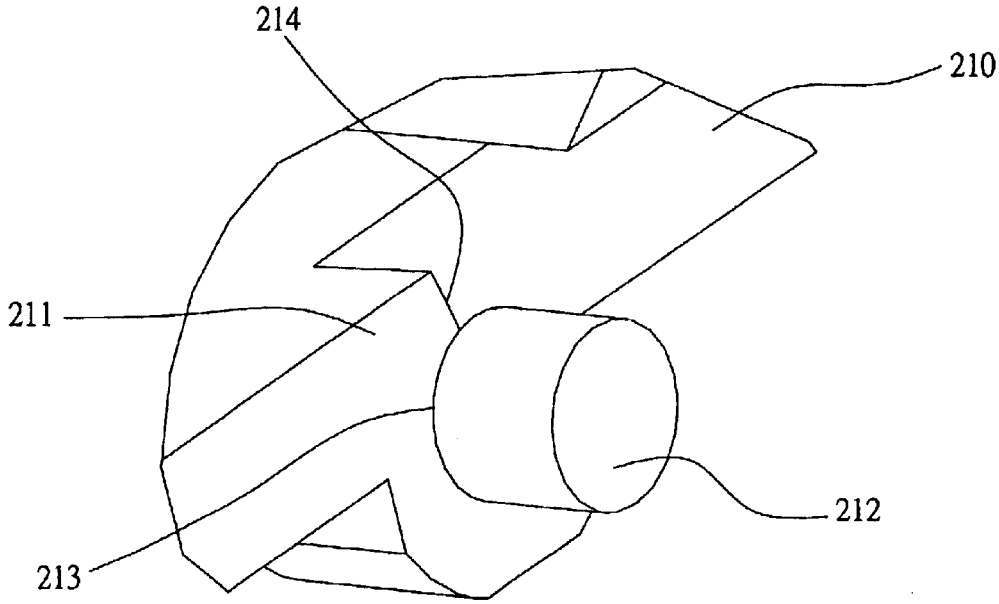
FIG. 2*a* depicts the first protrusion of the first embodiment.
Figure 2B:
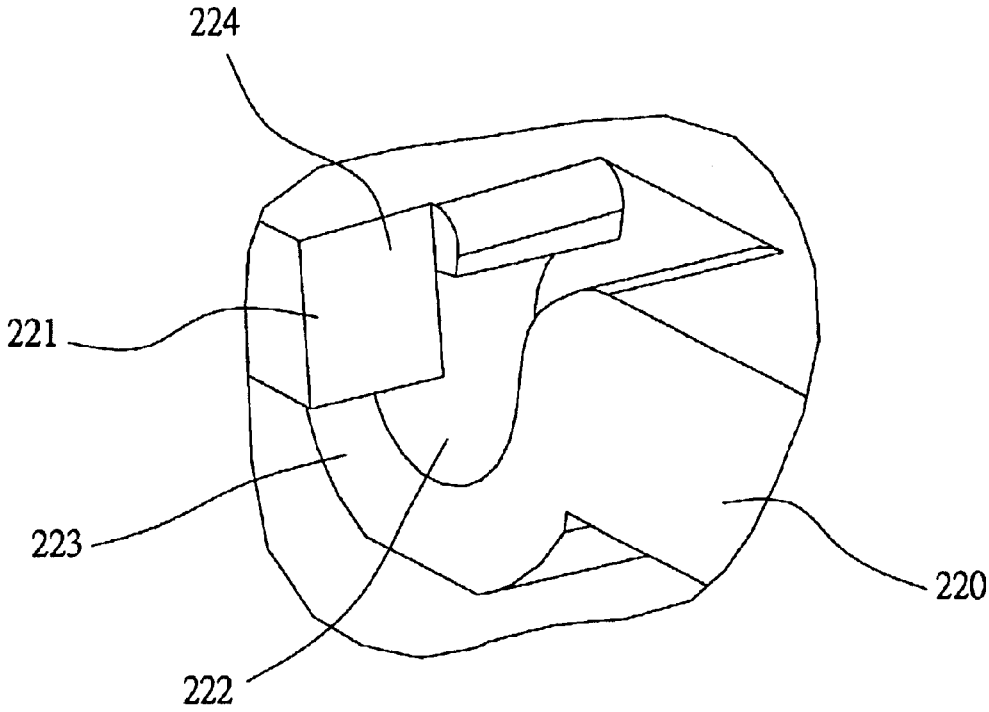
FIG. 2*b* depicts the second protrusion of the first embodiment.

Please refer to FIG. 2*a* and FIG. 2*b*. As FIG. 2*a* shows, the first frame 210 further includes a pivot 212. As FIG. 2*b* shows, the second frame 220 includes a depression 222. The pivot 212 is hinged to the second frame 220 through the depression 222, so that the first frame 210 may rotatably connect with the second frame 220.

As FIG. 2*a* shows, the first protrusion 211 connects with the pivot 212. More particularly, the first protrusion 211 connects with a bottom end 213 of the pivot 212. As FIG. 2*b* shows, the second protrusion 221 connects with an outside edge 223 defined by the depression 222.

Figure 3A:
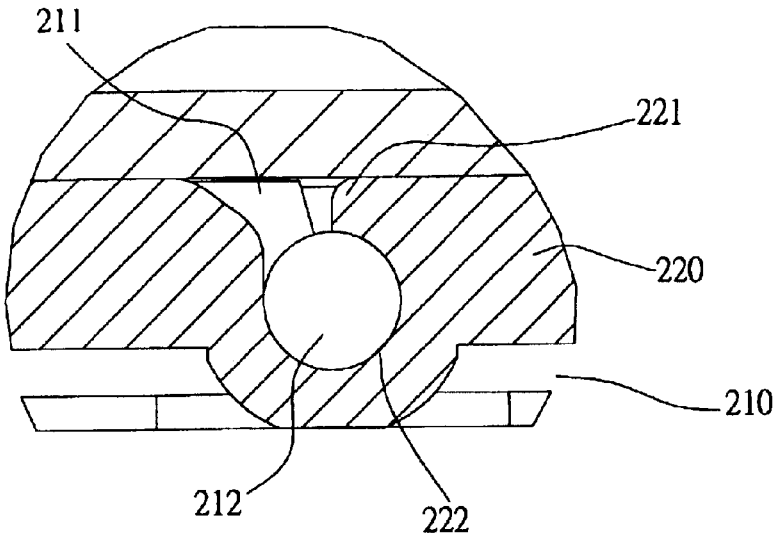
FIG. 3*a* shows a profile of the scissors-shaped member shown in FIG. 1*a;*
Figure 3B:
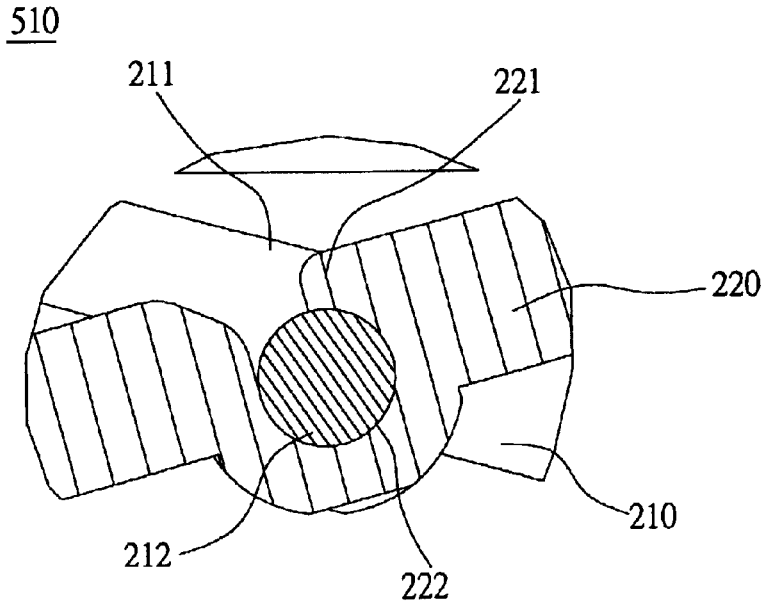
FIG. 3*b* shows a profile of the scissors-shaped member shown in FIG. 1*b;*

Please refer to FIG. 3*a* and FIG. 3*b*. FIG. 3*a* shows a profile of a scissors-shaped member 200 with the cap 300 depressed, and FIG. 3*b* shows an engagement between the first and second protrusions 211 and 221 when the cap is elevated to the first position 510. As FIG. 3*a* shows, the first protrusion 211 is separated from the second protrusion 221 while the cap 300 is depressed. When the cap 300 is released and elevated to the first position 510, as FIG. 3*b* shows, the first protrusion 211 engages with the second protrusion 221 to stop the cap 300.

Figure 4A:
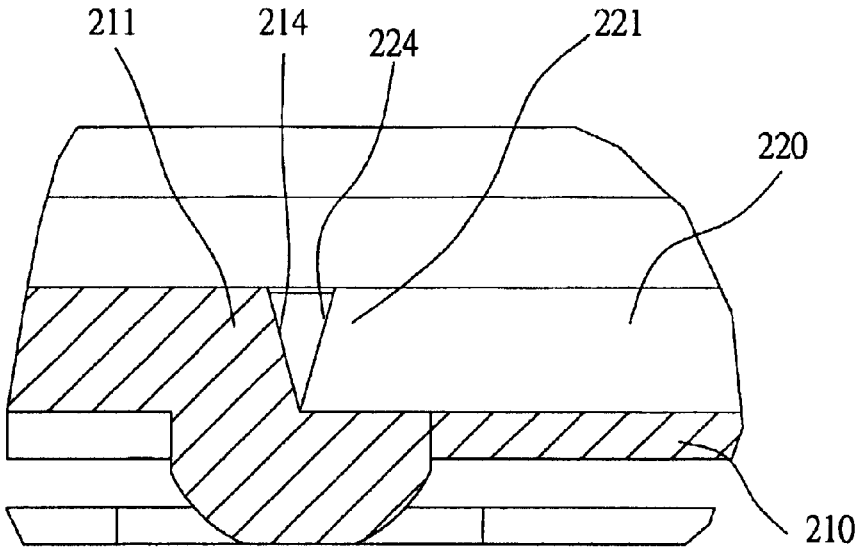
FIG. 4*a* depicts another embodiment of the present invention with the cap lowered to the second position.
Figure 4B:
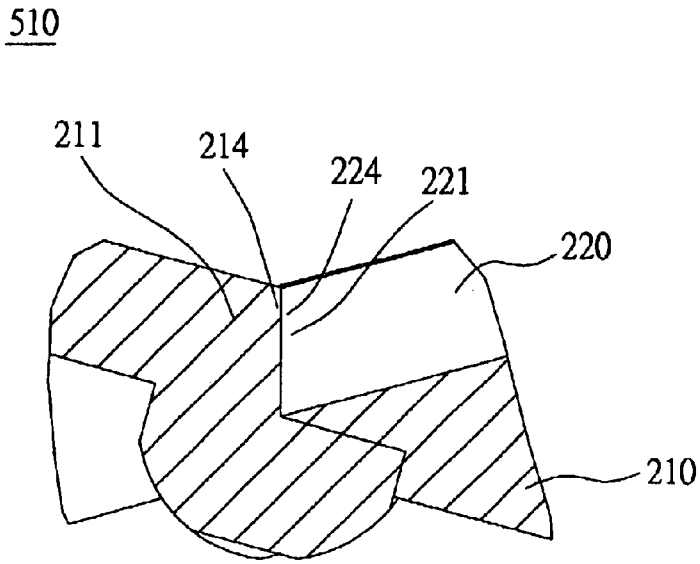
FIG. 4*b* depicts another view of the embodiment shown in FIG. 4*a* with the cap elevated to the first position.

In accordance with a particular embodiment of the invention illustrated in FIGS. 4*a* and 4*b*, the first protrusion 211 further includes a first end surface 214, and the second protrusion 221 includes a second end surface 224. As FIG. 4*a* shows, the first end surface 214 is separated from the second end surface 224 while the cap 300 is depressed. When the cap 300 is released and elevated to the first position 510, as FIG. 4*b* shows, the first end surface 214 contacts with the second surface end 224 to stop the cap 300.

Second Embodiment

The difference between the first embodiment and the second embodiment is that the downward stroke of the key may be limited in the second embodiment.

Figure 5A:
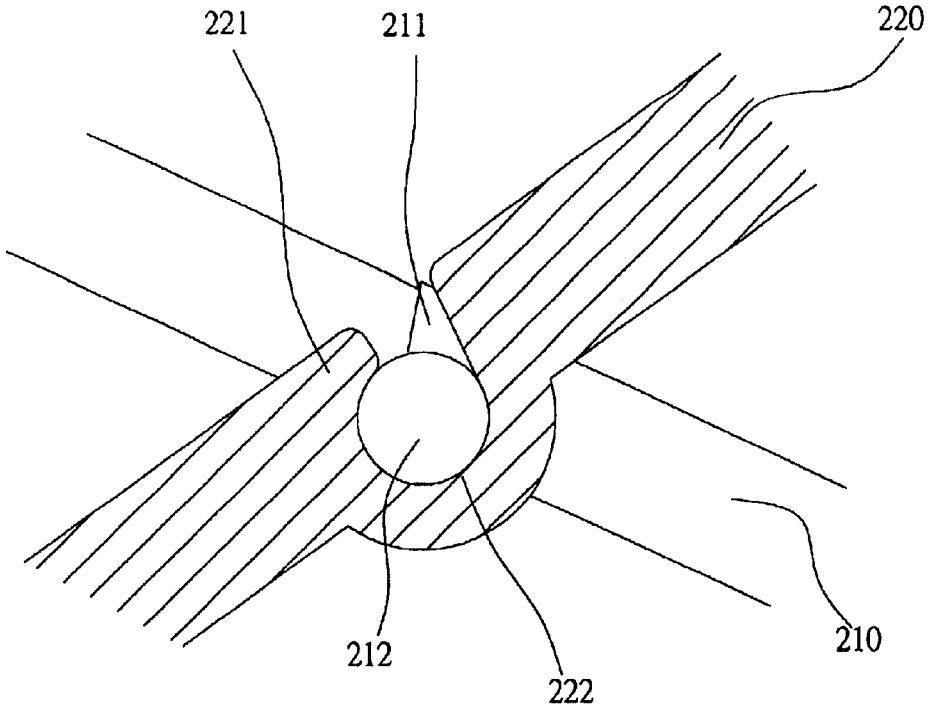
FIG. 5*a* shows a profile of the scissors-shaped member of a second embodiment with the cap elevated to the first position.
Figure 5B:
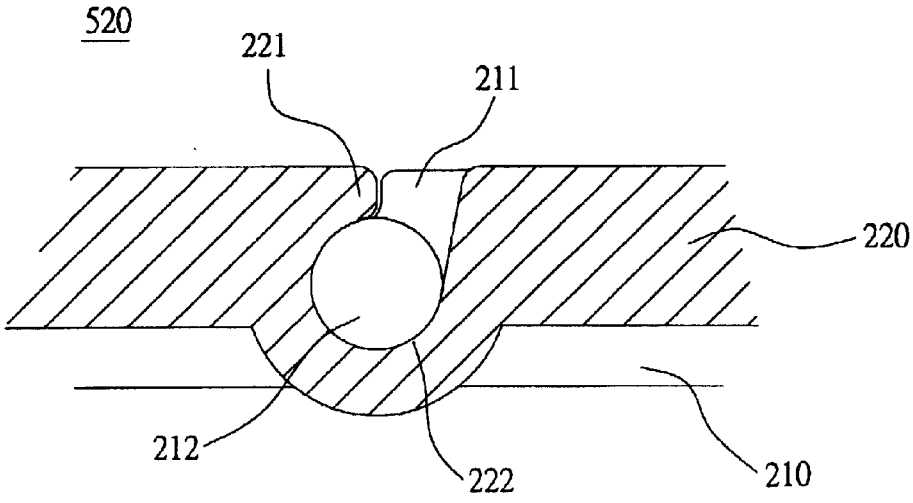
FIG. 5*b* shows a profile of the embodiment shown in FIG. 4*a* with the cap lowered to the second position.

Please refer to FIG. 5*a* and FIG. 5*b*. FIG. 5*a* shows a profile of a scissors-shaped member 200 with the cap 300 elevated, and FIG. 5*b* shows an engagement between the first and second protrusions 211 and 221 when the cap is lowered to a second position 520. As FIG. 5*a* shows, the first protrusion 211 is separated from the second protrusion 221 while the cap 300 is elevated. When the cap 300 is depressed and lowered to the second position 520, as FIG. 5*b* shows, the first protrusion 211 engages with the second protrusion 221 to stop the cap 300.

Figure 6A:
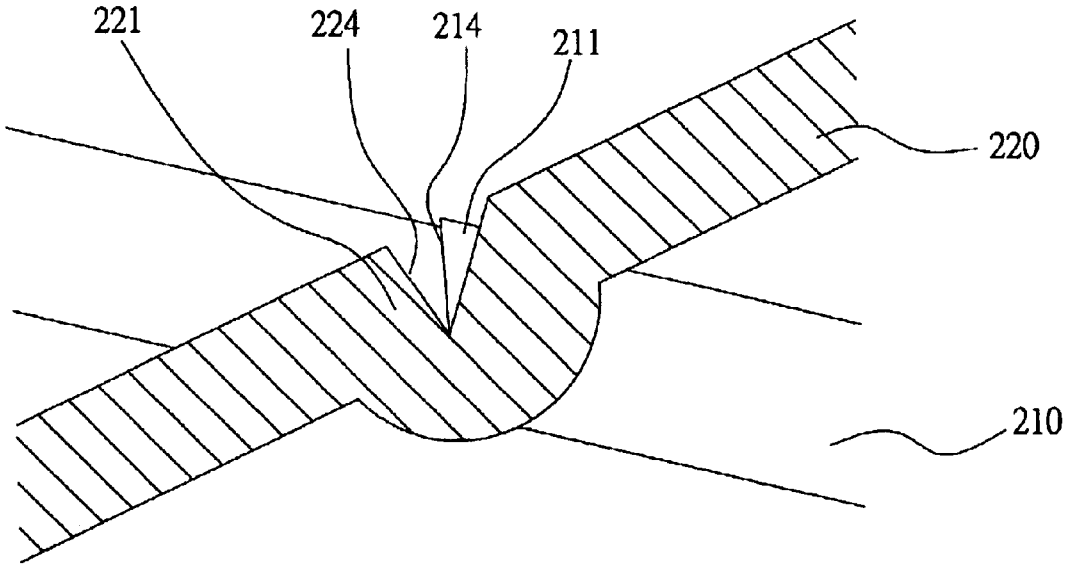
FIG. 6*a* shows another embodiment with the cap lowered to the second position.
Figure 6B:
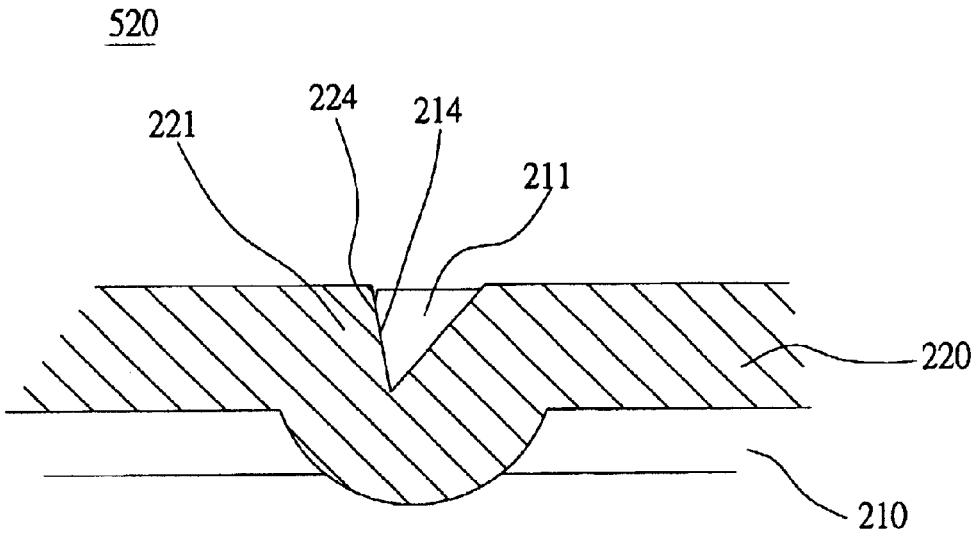
FIG. 6*b* shows the another view of the embodiment shown in FIG. 6*a* with the cap elevated to the first position.

In a particular embodiment, the first protrusion 211 further includes a first end surface 214, and the second protrusion 221 includes a second end surface 224. As FIG. 6*a* shows, the first end surface 214 is separated from the second end surface 224 while the cap 300 is elevated. When the cap 300 is depressed and lowered to the second position 520, as FIG. 6*b* shows, the first end surface 214 contacts with the second surface end 224 to stop the cap 300.

Third Embodiment

The difference between the third embodiment and the first and second embodiments described above, is that both the upward and downward strokes of the key may be limited in the third embodiment.

Figure 7A:
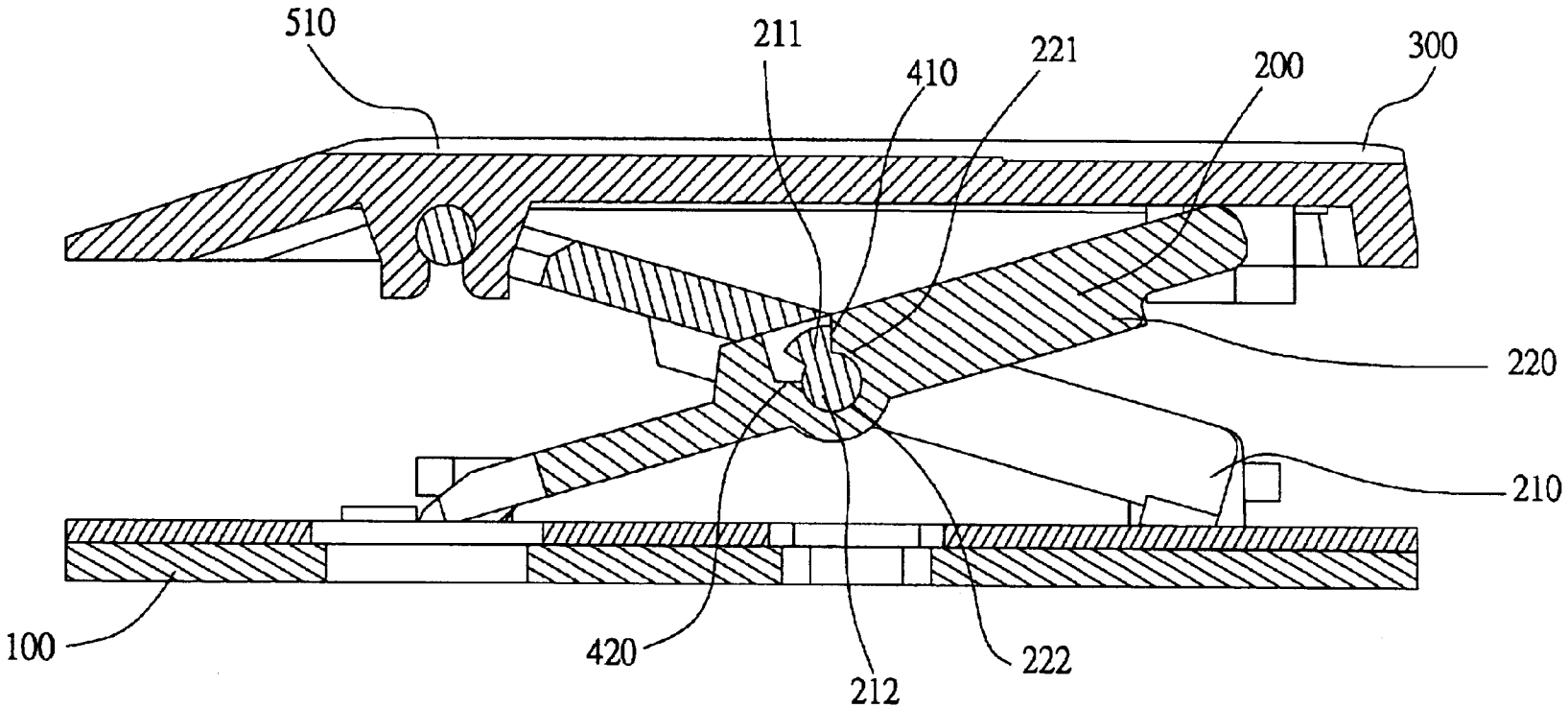
FIG. 7*a* depicts a third embodiment of the present invention with the cap elevated to the first position.
Figure 7B:
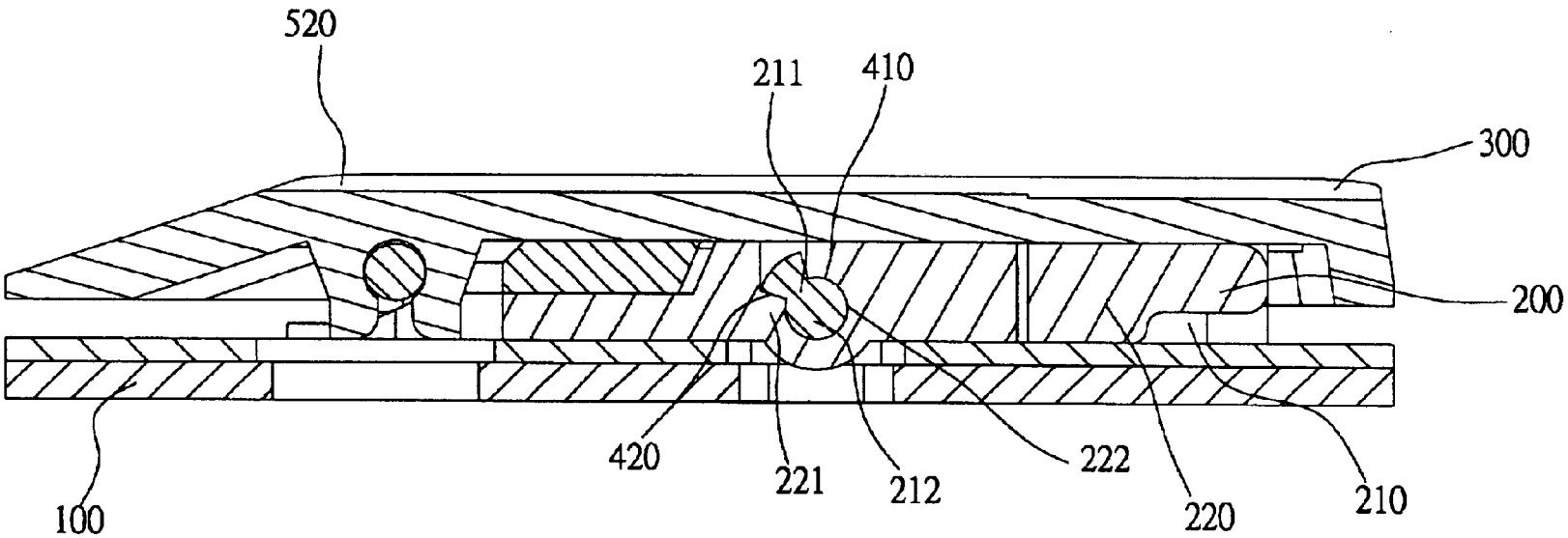
FIG. 7*b* depicts another view of the embodiment shown in FIG. 4*a* with the cap lowered to the second position.

Please refer to FIG. 7*a* and FIG. 7*b*. FIG. 7*a* shows a profile of the key with the cap 300 elevated, and FIG. 7*b* shows a profile of the key with the cap 300 depressed. In this embodiment, the first frame 210 includes a first protrusion 211, and the second frame 220 includes a second protrusion 221. The second protrusion 221 has a first end 410 and a second end 420. As FIG. 7*a* shows, the first protrusion 211 engages with the first end 410 to stop the cap 300 while the cap 300 is elevated to the first position 510. As FIG. 7*b* shows, the first protrusion 211 engages with the second end 420 to stop the cap 300 while the cap 300 is depressed to the second position 520.

Figure 8A:
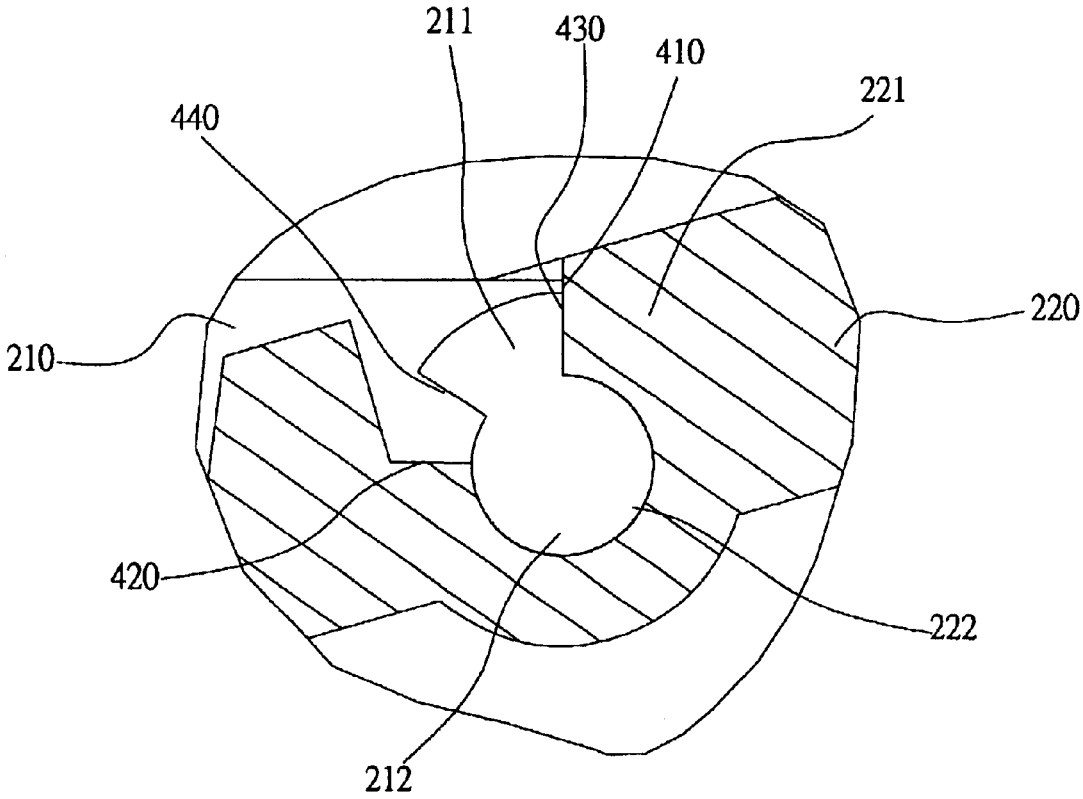
FIG. 8*a* shows a profile of the scissors-shaped member shown in FIG. 7*a*.
Figure 8B:
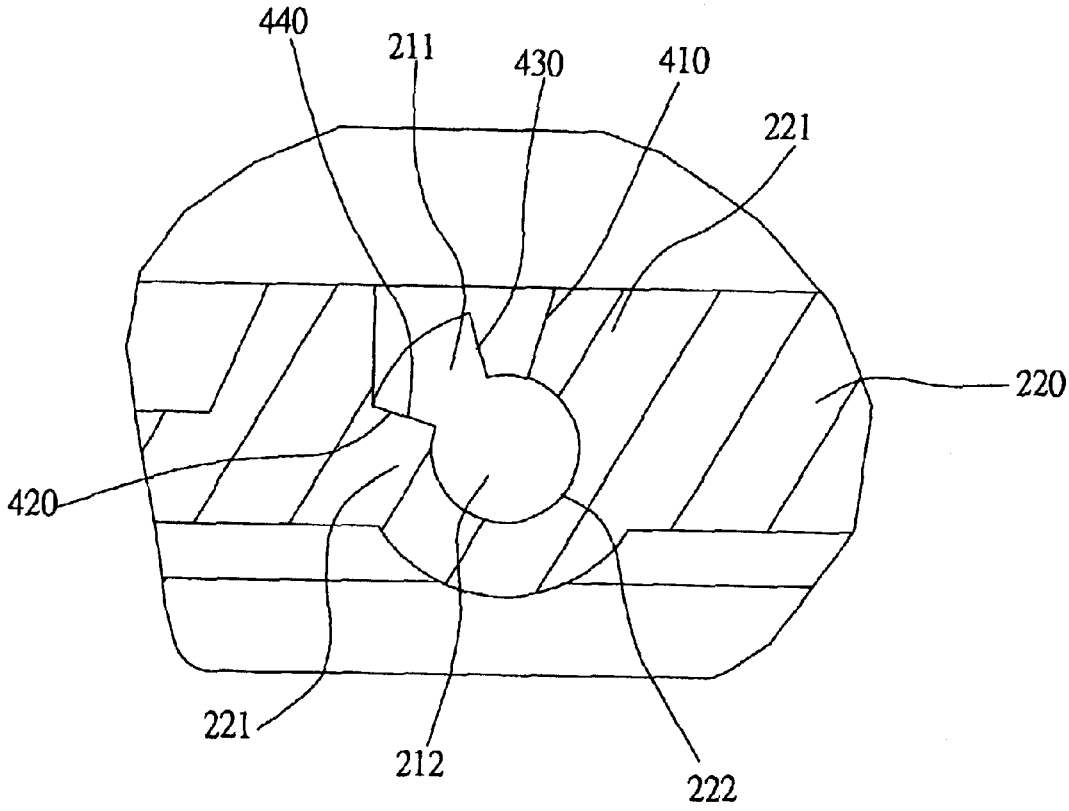
FIG. 8*b* shows a profile of the scissors-shaped member shown in FIG. 7*b*.

More particularly, the first protrusion 211 further includes a first end surface 430 and a second end surface 440. As FIG. 8*a* shows, the first end surface 430 contacts with the first end 410 to stop the cap 300 while the cap 300 is elevated to the first position 510. As FIG. 8*b* shows, the second end surface 440 contacts with the second end 420 to stop the cap 300 while the cap 300 is depressed to the second position 520.

The above description sets forth various exemplary embodiments of the invention only, and is not intended to limit the scope, applicability, or configuration of the invention in any way. Rather, various changes may be made in the function and arrangement of the elements described in these embodiments without departing from the spirit and scope of the invention. The protected scope of the present invention is as set forth in the appended claims.

We claim:

1. A key structure comprising:

a base;

a scissors-shaped member disposed on and connected with said base, said scissors-shaped member including a first frame and a second frame rotatably coupled to said first frame, said first frame including a first protrusion, and said second frame including a second protrusion; and a cap disposed on and connected with said scissors-shaped member;

wherein said cap moves vertically relative to said base due to a relative rotation between said first frame and said second frame, said first protrusion engages with the second protrusion to stop said cap when said cap is lowered to a second position.

2. The key structure of claim 1, wherein said first frame includes a pivot, said second frame includes a depression, and said pivot is hinged to said second frame through said depression.

3. The key structure of claim 2, wherein said first protrusion connects with a bottom end of said pivot.

4. The key structure of claim 2, wherein said second protrusion connects with an outside edge defined by said depression.

5. The key structure of claim 1, wherein said first protrusion includes a first end surface, and said second protrusion includes a second end surface, said first end surface contacts with said second end surface to stop said cap when said cap is lowered to said second position.

6. A key structure comprising:

a base;

a scissors-shaped member disposed on and connected with said base, said scissors-shaped member including a first frame and a second frame rotatably coupled to said first frame, said first frame including a first protrusion, and said second frame including a second protrusion, said second protrusion including a first end and a second end; and a cap disposed on and connected with said scissors-shaped member;

wherein said cap moves vertically relative to said base due to a relative rotation between said first frame and said second frame, said first protrusion engages with the first end to stop said cap when said cap is elevated to a first position, said first protrusion engages with the second end to stop said cap when said cap is lowered to a second position.

7. The key structure of claim 6, wherein said first frame includes a pivot, said second frame includes a depression, and said pivot is hinged to said second frame through said depression.

8. The key structure of claim 7, wherein said first protrusion connects with a bottom end of said pivot.

9. The key structure of claim 7, wherein said second protrusion connects with an outside edge defined by said depression.

10. The key structure of claim 6 wherein said first protrusion includes a first end surface and a second end surface, said first end surface contacts to said first end to stop said cap when said cap is elevated to said first position, said second end surface contacts to said second end to stop said cap when said cap is lowered to said second position.

* * * * *